US005709321A

United States Patent [19]

Smrt

[11] Patent Number: 5,709,321

[45] Date of Patent: Jan. 20, 1998

[54] APPARATUS FOR REMOTELY DISCHARGING THE CONTENTS OF AN AEROSOL CONTAINER

[76] Inventor: Thomas J. Smrt, 9716 S. Grant Hwy., Marengo, Ill. 60152

[21] Appl. No.: 605,399

[22] Filed: Feb. 22, 1996

[51] Int. Cl.[6] ..... B67D 5/06

[52] U.S. Cl. ..... 222/181.3; 222/402.14; 222/504

[58] Field of Search ..... 222/180, 181.3, 222/402.13, 402.14, 402.21, 504, 608, 325; 239/274, 289

[56] References Cited

U.S. PATENT DOCUMENTS

| | | | |
|---|---|---|---|
| 3,028,054 | 4/1962 | Beard, Jr. | 222/402.21 |
| 3,259,050 | 7/1966 | Grimm, III | 239/274 |
| 3,335,910 | 8/1967 | Rossi | 222/402.21 |
| 3,485,206 | 12/1969 | Smrt . | |
| 3,817,431 | 6/1974 | Kempton | 222/504 |
| 3,977,570 | 8/1976 | Smrt . | |
| 4,037,814 | 7/1977 | Clausen . | |
| 4,099,482 | 7/1978 | Smrt . | |
| 4,125,886 | 11/1978 | D'Agostino | 222/402.14 |
| 4,184,612 | 1/1980 | Freyre . | |
| 4,660,745 | 4/1987 | Hess, Jr. . | |
| 5,184,778 | 2/1993 | Noakes . | |
| 5,302,302 | 4/1994 | Shelley et al. . | |
| 5,318,208 | 6/1994 | van der Wal . | |
| 5,338,129 | 8/1994 | Oden . | |
| 5,368,202 | 11/1994 | Smrt . | |
| 5,385,271 | 1/1995 | Bierend et al. . | |
| 5,518,148 | 5/1996 | Smrt . | |

*Primary Examiner*—Philippe Derakshani
*Attorney, Agent, or Firm*—Leydig, Voit & Mayer, Ltd.

[57] ABSTRACT

An apparatus for discharging the contents of an aerosol container, the container having an actuator which can be moved between discharging and non-discharging positions, the apparatus comprising: member for holding the aerosol container in an inverted position; electrically-operable operable actuating member which effects movement of the aerosol container actuator between discharging and non-discharging positions; a member in electrical connection with the actuating member for controlling movement of the actuating member, and thereby the aerosol container actuator, between discharging and non-discharging positions; and member for providing electrical power to the apparatus, wherein the controlling member is disposed remotely from the holding member and the actuating member so that an operator of the apparatus is able to discharge the contents of the aerosol container without being in physical contact with the holding member and actuating member.

16 Claims, 4 Drawing Sheets

APPARATUS FOR REMOTELY DISCHARGING THE CONTENTS OF AN AEROSOL CONTAINER

FIELD OF THE INVENTION

This invention generally relates to devices for discharging the contents of aerosol containers.

BACKGROUND OF THE INVENTION

The use of aerosol containers for dispensing marking compositions is well-known, e.g. for striping roadways, sidewalks, airport runways, and grass on golf courses and sport fields. When applying such markings, however, the container must be relatively close to the surface being marked due to the limitations inherent in such pressurized containers.

A number of devices have been developed which allow a person making such marks using aerosol containers to remain relatively upright while the container is positioned relatively close to the surface to be marked. Examples of devices which provide this feature, and further allow the discharge of the aerosol container to be controlled by the user via a mechanically-operated mechanism, are provided by U.S. Pat. Nos. 3,485,206, 3,977,570, 4,099,482, and 4,660,745. Additionally, U.S. Pat. No. 5,318,208 discloses a spraying device that utilizes a electrically-operated mechanism to open a valve connected to the interior of the aerosol container. However, as with the devices utilizing mechanically-operated mechanisms, the device disclosed in the '208 patent has an electrically-operated trigger mounted adjacent to the aerosol container on the device. Furthermore, the device disclosed in the '208 patent is hand-held, thereby requiring the user to be bent over in order to make a mark on the ground.

While the foregoing devices solve some of the problems associated with marking surfaces using aerosol containers, other problems remain. In particular, it is often necessary to mark large areas or to mark areas that are some distance from one another. In these situations, the user frequently uses a vehicle to traverse the distances between the areas to be marked. For example, when marking hazards on a golf course it is often necessary to traverse long distances between hazards, e.g. from one fairway to the next. In order to move between the fairways, the user of the spraying device will frequently use a vehicle such as a golf cart. However, each time a hazard is encountered, a user will be required to exit the golf cart, walk about the hazard making the mark, and then reenter the golf cart. The walking about relatively large hazards, as well as repeated exiting and reentering of the golf cart are time-consuming and inefficient.

Accordingly, a need exists for an apparatus which overcomes the drawbacks of these prior art systems.

The specific advantages of the present invention, as well as additional inventive features, will be apparent from the description of the invention provided herein.

SUMMARY OF THE INVENTION

The present invention provides an apparatus for discharging the contents of an aerosol container wherein, preferably, a portion of the apparatus may be mounted on the exterior of the vehicle and the controlling portion may be mounted in the interior of the vehicle, next to the operator. In one embodiment, the apparatus comprises: means for holding the aerosol container in an inverted position; electrically-operable actuating means which effects movement of the aerosol container actuator between discharging and non-discharging positions; means in electrical connection with the actuating means for controlling movement of the actuating means, and thereby the aerosol container actuator, between discharging and non-discharging positions; and means for providing electrical power to the apparatus, wherein the controlling means is disposed remotely from the holding means and the actuating means so that an operator of the apparatus is able to discharge the contents of the aerosol container without being in physical contact with the holding means and actuating means.

A further embodiment of the invention comprises a system wherein the discharging apparatus is mounted onto a vehicle.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

In accordance with one embodiment of the present invention, there is provided an apparatus for remotely discharging the contents of an aerosol container. The remote discharging apparatus allows the user to discharge the contents of the aerosol container without being in physical contact with the structure support the aerosol container. Upon the integration of the remote discharging apparatus with a vehicle, the present invention further provides for efficient marking of large areas and areas that are some distance from one another.

Figure 1:
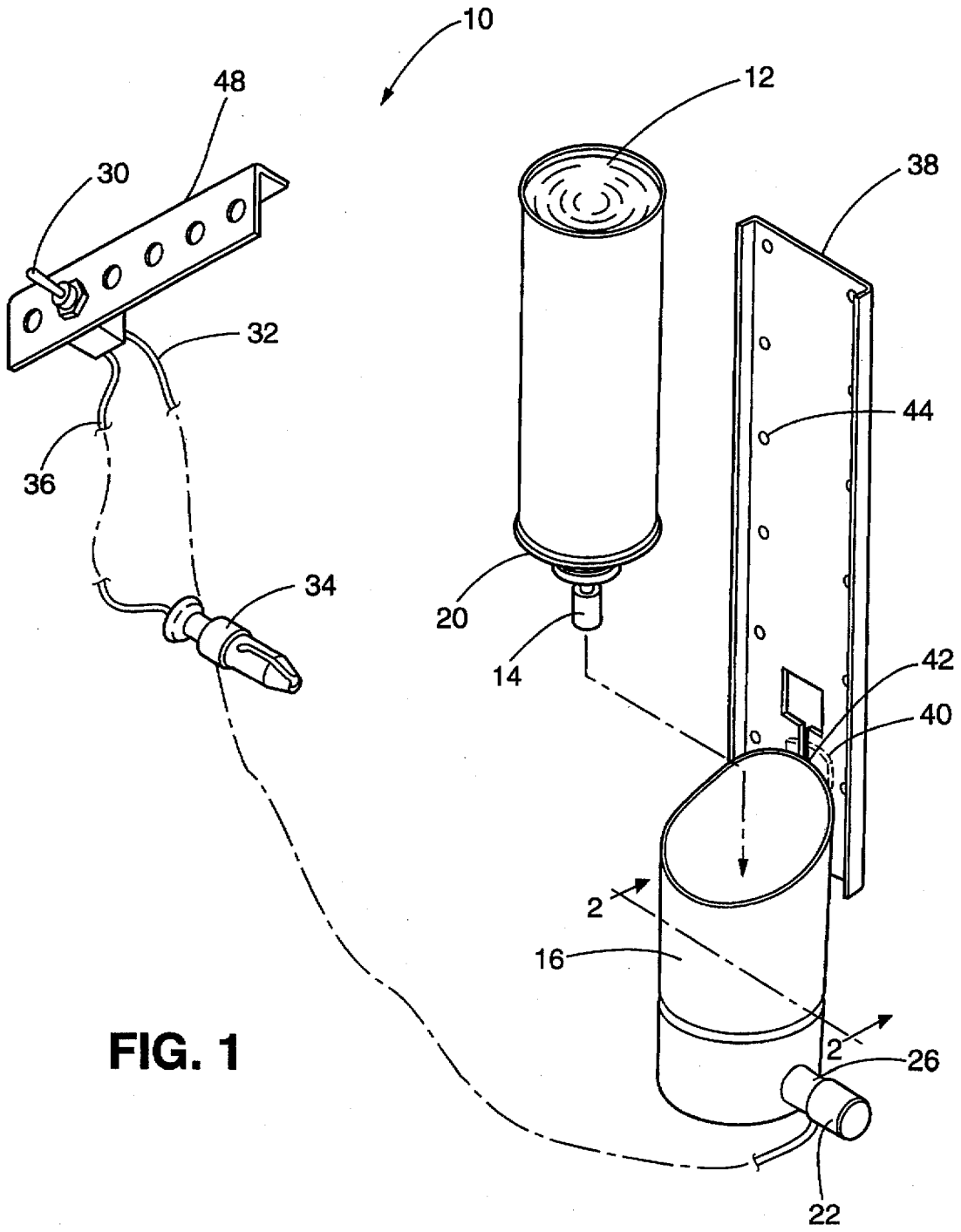
FIG. 1 is a perspective view of an apparatus for remotely controlling the discharge of the contents of an aerosol container constructed according to one embodiment of the present invention.

Turning initially to FIG. 1, there is illustrated a preferred embodiment of the remote discharging apparatus 10 of the present invention which can be used with conventional aerosol containers 12. The aerosol container 12 includes an actuator 14 that moves between non-discharging and discharging positions, thereby controlling a valve (not shown) mounted on the aerosol container 12. In the non-discharging position, the actuator 14 is completely vertical, as shown in solid lines in FIG. 2. In the discharging position, the actuator 14 is angularly disposed relative to the completely vertical position that characterizes the non-discharging position, as shown in broken lines in FIG. 2. As will be described in more detail below, the angular displacement of the actuator 14 from the completely vertical position causes the valve mounted on the aerosol container 12 to open, thereby discharging the contents of the aerosol container 12. Movement of the actuator 14 back into the completely vertical position causes the valve mounted on the aerosol container 12 to close, thereby halting the discharge of the aerosol container contents.

Figure 2:
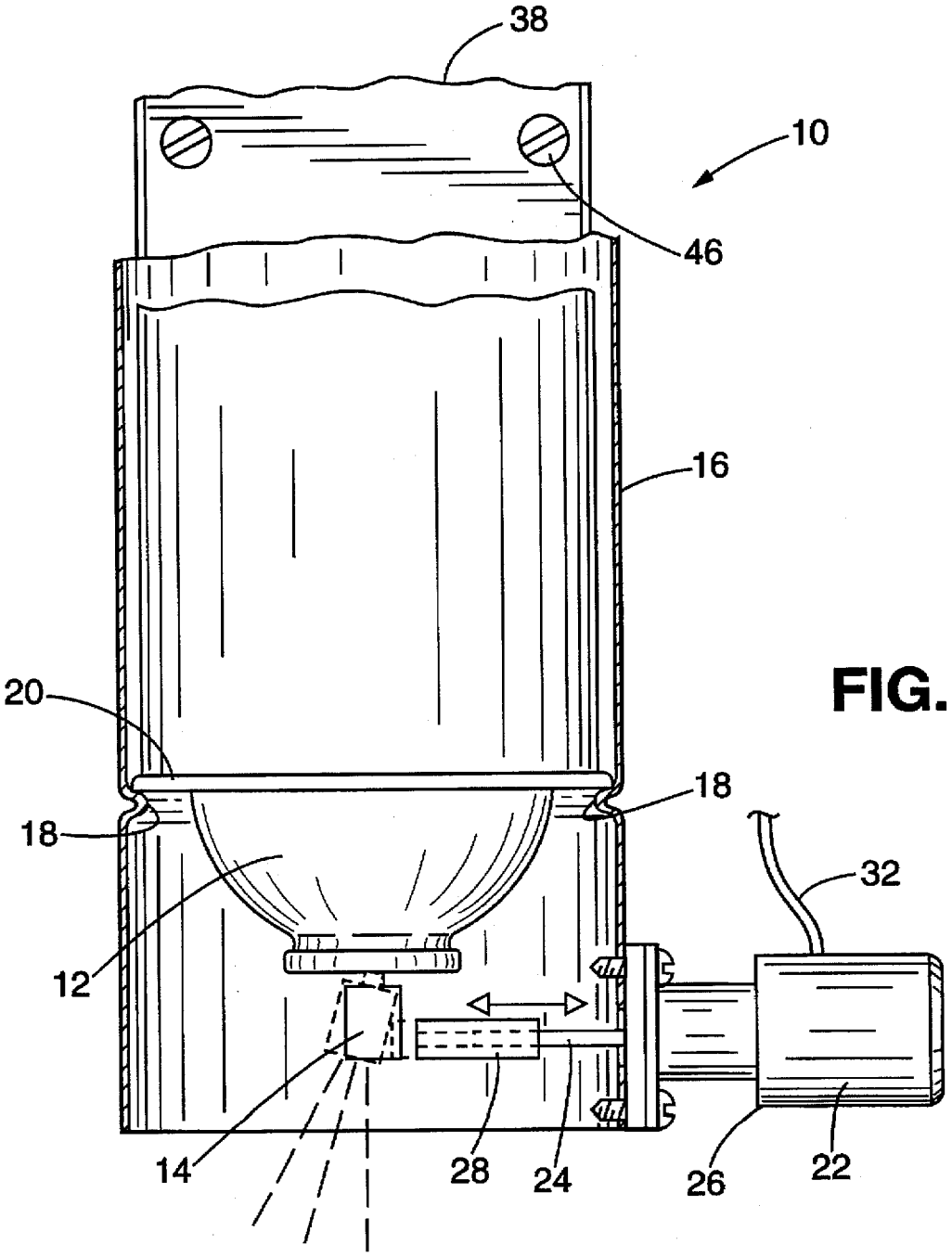
FIG. 2 is a sectional view taken along line 2—2 in FIG. 1 showing the discharging position of the aerosol container actuator and the extended position of the solenoid arm in broken lines and the non-discharging position of the aerosol container actuator and the retracted position of the solenoid arm in solid lines.

The discharging apparatus 10 includes means for holding the aerosol container 12 in the inverted position such that it can be used to mark a surface. In a preferred embodiment, the container holding means comprises a generally cylindrical structure 16 sized to receive the aerosol container 12, as best shown in FIGS. 1 and 2. Within the cylindrical structure 16 is an annular flange 18, as shown in FIG. 2. The annular flange 18 includes a central opening which allows the top of the aerosol container 12, including the actuator 14, to extend therethrough. The annular flange 18 is sized so as to contact a ridge portion 20 which extends from a typical aerosol can (FIG. 2). Thus, the annular flange 18 serves to properly position and retain the aerosol container 12 within the cylindrical structure 16.

In order to effectuate movement of the aerosol can actuator 14 between the discharging and non-discharging positions, the remote discharging apparatus 10 includes electrically-operable actuating means. Preferably, the actuating means comprises a solenoid 22 that includes an arm 24 mounted to a housing 26, as best shown in FIG. 2. The solenoid housing 26 is mounted on the container holding structure 16 so that the solenoid arm 24 is in substantially the same horizontal plane as the aerosol container actuator 14. Additionally, the solenoid arm 24 is mounted to the solenoid housing 26 so that the solenoid arm 24 can move relative to the solenoid housing between retracted or non-discharging and extended or discharging positions in response to a flow of current to the solenoid 22.

When the solenoid 22 is energized, the arm 24 extends outwardly from the solenoid 22 in a direction transverse to the longitudinal axis of the aerosol container actuator 14 into the extended or discharging position, shown in broken lines in FIG. 2. In the extended or discharging position, the solenoid arm 24 effects movement of the aerosol can actuator 14 into the discharging position. When the solenoid 22 is de-energized, a spring (not shown) in the aerosol container valve (not shown) biases the actuator 14 back into the non-discharging position, thereby pushing the solenoid arm 24 back into the retracted or non-discharging position, shown in solid lines in FIG. 2.

To increase the contact surface of the solenoid arm 24, the solenoid arm 24 is preferably equipped with a plastic sleeve 28 that is disposed on the free end thereof, as shown in FIG. 2. The increased contact surface afforded by the plastic sleeve 28 compensates for any misalignment between the actuator 14 and the solenoid arm 24.

The discharging apparatus 10 also includes means for controlling the movement of the actuating means or solenoid 22, and thereby the aerosol container actuator 14, between the discharging and non-discharging positions. The control means is disposed remotely from the container holding structure 16 and the solenoid 22 and in electrical connection with the solenoid 22 so that an operator of the discharging apparatus 10 is able to discharge the contents of the aerosol container 12 without being in physical contact with the solenoid 22 or the container holding structure 16. In a preferred embodiment, the actuating means comprises a switch 30 having discharging and non-discharging positions that is electrically connected to the solenoid 22 by a wire 32, as shown in FIG. 1. Preferably, the switch 30 is a three way toggle switch that provides a hands-free continuous discharging operation by enabling a user to lock the switch 30, and thereby the solenoid arm 24 and the actuator 14, into the discharging position. The switch 30 may be disposed within a vehicle and, in particular, in the cab of a vehicle so that the operator of the vehicle may operate the discharging apparatus 10 without exiting the vehicle.

The discharging apparatus 10 also includes means for providing electrical power to the discharging apparatus 10 and, in particular, to the solenoid 22. In the illustrated embodiment, the electrical power means comprises a plug 34 which can be inserted into a lighter socket (not shown) of a vehicle. As shown in FIG. 1, the plug 34 is electrically connected with the switch 30 and the solenoid 22 by a wire 36. The length of the wire can be adjusted, as desired, in order to ensure that the plug 34 can reach the vehicle lighter socket. Those skilled in the art will appreciate that other types of plugs and wiring schemes may also be used.

Figure 3:
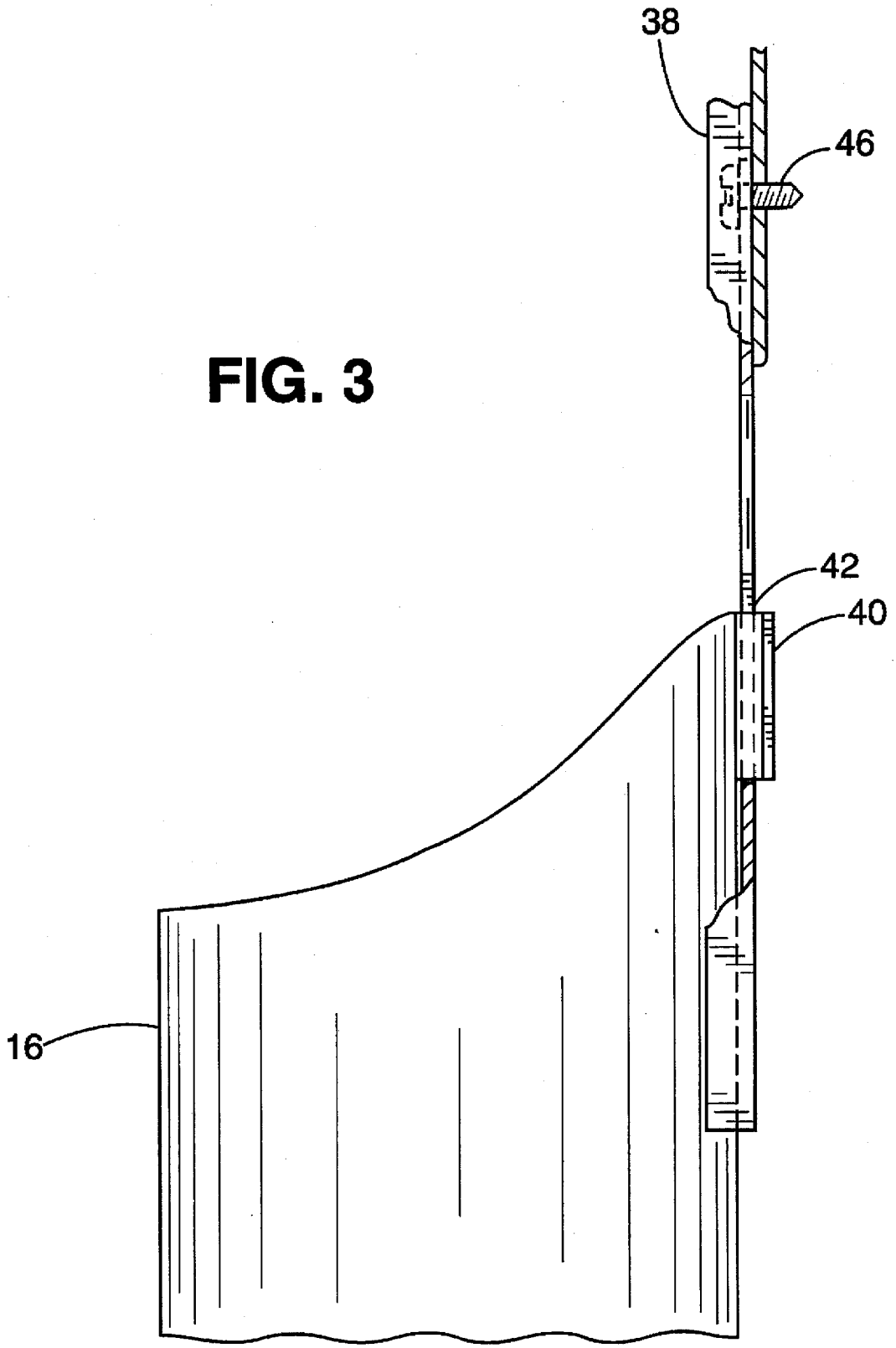
FIG. 3 is a partial side view of the remote discharging apparatus of FIG. 1 showing the container holding structure attached to the mounting bracket.

In order to use the discharging apparatus 10 to mark large areas or areas that are some distance from one another, the discharging apparatus 10 may include means for mounting the container holding structure 16 to a vehicle. In the illustrated embodiment, the mounting means comprises a mounting bracket 38 and a tab 40 attached to the container holding structure 16 by a neck portion 42 as shown in FIGS. 1 and 3. The container holding structure 16 is attached to the mounting bracket 38 by sliding the neck portion 42 into a slot in the mounting bracket 38 such that the tab 40 is on the opposite side of the mounting bracket 38 from the container holding structure 16, as best shown in FIG. 3. Those skilled in the art will appreciate that other methods of attaching the container holding structure 16 to a vehicle may also be utilized, such as bolts, screws, glues, magnets or hook and loop fasteners.

Figure 4:
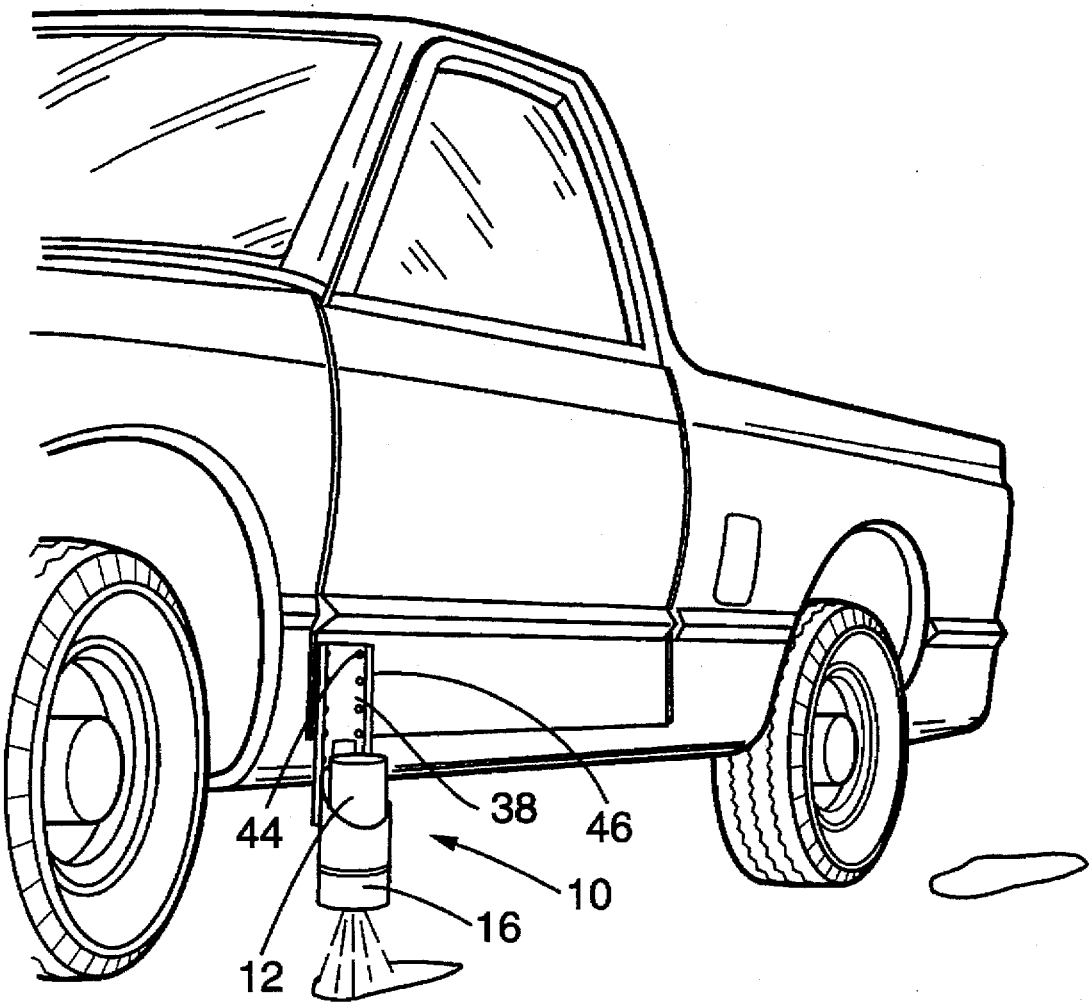
FIG. 4 is a perspective drawing showing another embodiment of the present invention attached to a truck.

In order to facilitate attachment of the mounting bracket 38 and thereby the container holding structure 16 to the vehicle, the illustrated mounting bracket 38 includes a plurality of holes, one of which is referenced as 44 in FIGS. 1 and 4. The plurality of holes 44 enable the mounting bracket 38 to be attached to the vehicle in a variety of ways. For example, in the illustrated embodiment, the mounting bracket 38 is attached to the body of the vehicle by a plurality of sheet metal screws 46, as shown in FIGS. 2–4. Alternatively, the mounting bracket 38 could be mounted to the bumper of the vehicle or to a horizontal or vertical post on the vehicle using conventional "U" bolts. The mounting bracket 38 also could be attached via magnets to a portion of the vehicle constructed from metal, e.g. the bumper or a body panel.

The plurality of holes 44 also enable the mounting height to be readily adjusted. The distance between the aerosol can actuator 14 and the surface to be marked may vary depending upon the type and quality of mark that is desired although a distance of about 1 inch to about 10 inches is often suitable. The mounting bracket 38 should be placed in an appropriate position to achieve the desired distance.

Once the container holding structure 16 is attached to the vehicle, the switch 30 may be mounted inside the cab of the vehicle. A switch holder 48 such as that illustrated in FIG. 1, may be used to help mount the switch 30 so that the switch 30 is accessible to the operator of the vehicle. An aerosol container 12 containing the desired marking composition may then be placed with the actuator 14 down into the container holding structure 16. To make the discharging apparatus 10 ready for use, the plug 34 is inserted into the lighter socket of the vehicle.

When the foregoing arrangement is utilized, an operator of the vehicle upon reaching reaches an area where he or she wishes to place a mark need not exit the vehicle. Rather, he or she need only place the switch 30 into the discharging position. The switch 30 allows current to flow to the solenoid 22, thereby causing the solenoid arm 24 to extend outwardly from the solenoid housing 26 into the extended position. The solenoid arm 24 extends into contacting relation with the aerosol can actuator 14 and acts to angularly displace the actuator 14 causing the valve mounted on the container to open and marking composition to be discharged. If the operator of the discharging apparatus 10 desires to mark a large area, he or she may place the switch 30 in the discharging position and continue to use both hands to operate the vehicle.

When the operator wishes to stop discharging the marking composition, he or she need only place the switch 30 in the non-discharging position. The placement of the switch 30 in the non-discharging position halts the current flow to the solenoid 22. Once the current is halted, the bias of the spring (not shown) included in the aerosol container valve (not shown) moves the actuator 14 back into the totally vertical non-discharging position. The movement of the actuator 14 in response to the spring causes the arm 24 of the solenoid 22 to move back into the solenoid housing 26 and into the retracted position.

While this invention has been described with an emphasis upon preferred embodiments, it will be obvious to those of ordinary skill in the art that variations of the preferred embodiments may be used and that it is intended that the invention may be practiced otherwise than as specifically described herein. Further, this invention is not limited to use with any particular vehicle but may be used in a multitude of vehicles including but not limited to golf carts, industrial vehicles including trucks ranging from pick-up trucks to dump trucks, mobile cranes, tractors, forklifts, and automobiles. Accordingly, this invention includes all modifications encompassed within the spirit and the scope of the invention as defined by the following claims.

What is claimed is:

1. An apparatus for discharging the contents of an aerosol container, the container having an actuator which can be moved between discharging and non-discharging positions, the apparatus comprising:

(a) means for holding the aerosol container in an inverted position, (b) electrically-operable actuating means which effects movement of the aerosol container actuator between discharging and non-discharging positions, (c) means in electrical connection with the actuating means for controlling movement of the actuating means, and thereby the aerosol container actuator, between discharging and non-discharging positions, wherein the controlling means is disposed remotely from the holding means and the actuating means so that an operator of the apparatus is able to discharge the contents of the aerosol container without being in physical contact with the holding means and actuating means, and (d) means for providing electrical power to the apparatus.

2. The apparatus of claim 1, wherein the actuating means comprises a solenoid.

3. The apparatus of claim 2, wherein the solenoid includes an arm attached to the solenoid for transverse movement relative to the aerosol container actuator, wherein when the solenoid is in the discharging position, the arm contacts and displaces the container actuator into the discharging position.

4. The apparatus of claim 2, wherein the controlling means comprises a switch.

5. The apparatus of claim 4, wherein the switch comprises a toggle switch.

6. The apparatus of claim 4, wherein the holding means comprises a generally cylindrical structure having an internal flange which is sized to retain the inverted aerosol container within the structure.

7. The apparatus of claim 1, further comprising means for mounting the holding means to a vehicle.

8. The apparatus of claim 7, wherein the mounting means comprises a tab connected to the holding means by a neck portion and a mounting bracket having a slot sized to receive the neck portion and being adapted for connection to a vehicle.

9. The apparatus of claim 7, wherein the controlling means is positioned within the vehicle so a vehicle operator can operate the controlling means without exiting the vehicle.

10. The apparatus of claim 9, wherein the vehicle includes a cab and the controlling means is mounted in the cab of the vehicle.

11. The apparatus of claim 10, wherein the actuating means comprises a solenoid, the controlling means comprises a switch, the holding means comprises a generally cylindrical structure having an internal flange which is sized to retain the inverted aerosol container within the structure, and the means for providing electrical power is a plug which can be inserted into a lighter socket of the vehicle.

12. A system for discharging the contents of an aerosol container, the container having an actuator which can be moved between discharging and non-discharging positions, the system comprising: (a) a vehicle having an electrical power supply and (b) an apparatus mounted on the vehicle comprising:

means for holding the aerosol container in an inverted position, means for mounting the apparatus onto the vehicle, a solenoid which effects movement of the aerosol container actuator between discharging and non-discharging positions, a switch in electrical connection with the solenoid for controlling movement of the solenoid, wherein the switch is positioned within the vehicle so the vehicle operator can operate the switch without exiting the vehicle, and means for connecting the switch and the solenoid to the electrical power supply of the vehicle.

13. The system of claim 12 further comprising the aerosol container in the holding means.

14. The system of claim 13, wherein the holding means comprises a generally cylindrical structure having an internal flange which is sized to retain the inverted aerosol container within the structure.

15. The system of claim 14 wherein the means for connecting the switch and the solenoid to the electrical power supply of the vehicle is a plug which can be inserted into a lighter socket of the vehicle.

16. The system of claim 15, wherein the mounting means comprises a tab connected to the holding means by a neck portion and a mounting bracket having a slot sized to receive the neck portion and being adapted for connection to a vehicle.

* * * * *